US005904244A

United States Patent [19]

Focke et al.

[11] Patent Number: 5,904,244

[45] Date of Patent: May 18, 1999

[54] HINGE-LID BOX FOR CIGARETTES AND BLANK

[75] Inventors: Heinz Focke, Verden; Henry Buse, Visselhövede, both of Germany

[73] Assignee: Focke & Co. (GmbH & Co.), Verden, Germany

[21] Appl. No.: 08/968,296

[22] Filed: Nov. 12, 1997

[30] Foreign Application Priority Data

Nov. 21, 1996 [DE] Germany ..... 196 48 240

[51] Int. Cl.[6] ..... B65D 85/10

[52] U.S. Cl. ..... 206/268; 206/273; 229/160.1

[58] Field of Search ..... 206/265, 268, 206/271, 273, 264; 229/160.1

[56] References Cited

U.S. PATENT DOCUMENTS

| | | | |
|---|---|---|---|
| 2,848,152 | 8/1958 | Geiger, Sr. | 229/160.1 |
| 3,963,173 | 6/1976 | Stone . | |
| 4,294,399 | 10/1981 | Wilfer | 229/160.1 |
| 4,392,338 | 7/1983 | Fox | 206/268 X |
| 4,526,317 | 7/1985 | Cassidy | 229/160.1 X |
| 4,753,383 | 6/1988 | Focke et al. | 229/160.1 |
| 4,753,384 | 6/1988 | Focke et al. | 229/160.1 |
| 5,207,322 | 5/1993 | Focke et al. | 206/268 |
| 5,586,648 | 12/1996 | Focke et al. | 206/264 |

FOREIGN PATENT DOCUMENTS

| | | | |
|---|---|---|---|
| 1592358 | 6/1970 | France . | |
| 2596730 | 10/1987 | France | 229/160.1 |
| 29 13 891 A1 | 6/1980 | Germany . | |
| 29 40 421 A1 | 4/1981 | Germany . | |
| 44 04 146 A1 | 8/1995 | Germany . | |
| 1009835 | 11/1965 | United Kingdom . | |

*Primary Examiner*—Bryon P. Gehman
*Attorney, Agent, or Firm*—Abelman, Frayne & Schwab

[57] ABSTRACT

A hinge-lid box for cigarettes, and a blank for producing the same. Hinge-lid box (hinge-lid packs) for cigarettes usually comprise a box part 11 and a lid 12 which is connected pivotably on the box part 11. Positioned in the box part 11 is a collar 34 which, by way of a top region, partially projects out of the box part 11 when the hinge-lid box 10 is open. The hinge-lid box 10 according to the invention has a closure aid in the region of side walls 16, 17 of the box part 11 and in the region of lid side walls 26, 27. Formed, for this purpose, in the region of the side walls 16, 17 and lid side walls 26, 27 are mutually corresponding protrusions 44, 45 and depressions 46, 47 which, in the closed position, engage with one another in a frictionally and positively locking manner.

3 Claims, 3 Drawing Sheets

HINGE-LID BOX FOR CIGARETTES AND BLANK

DESCRIPTION

Figure 1:
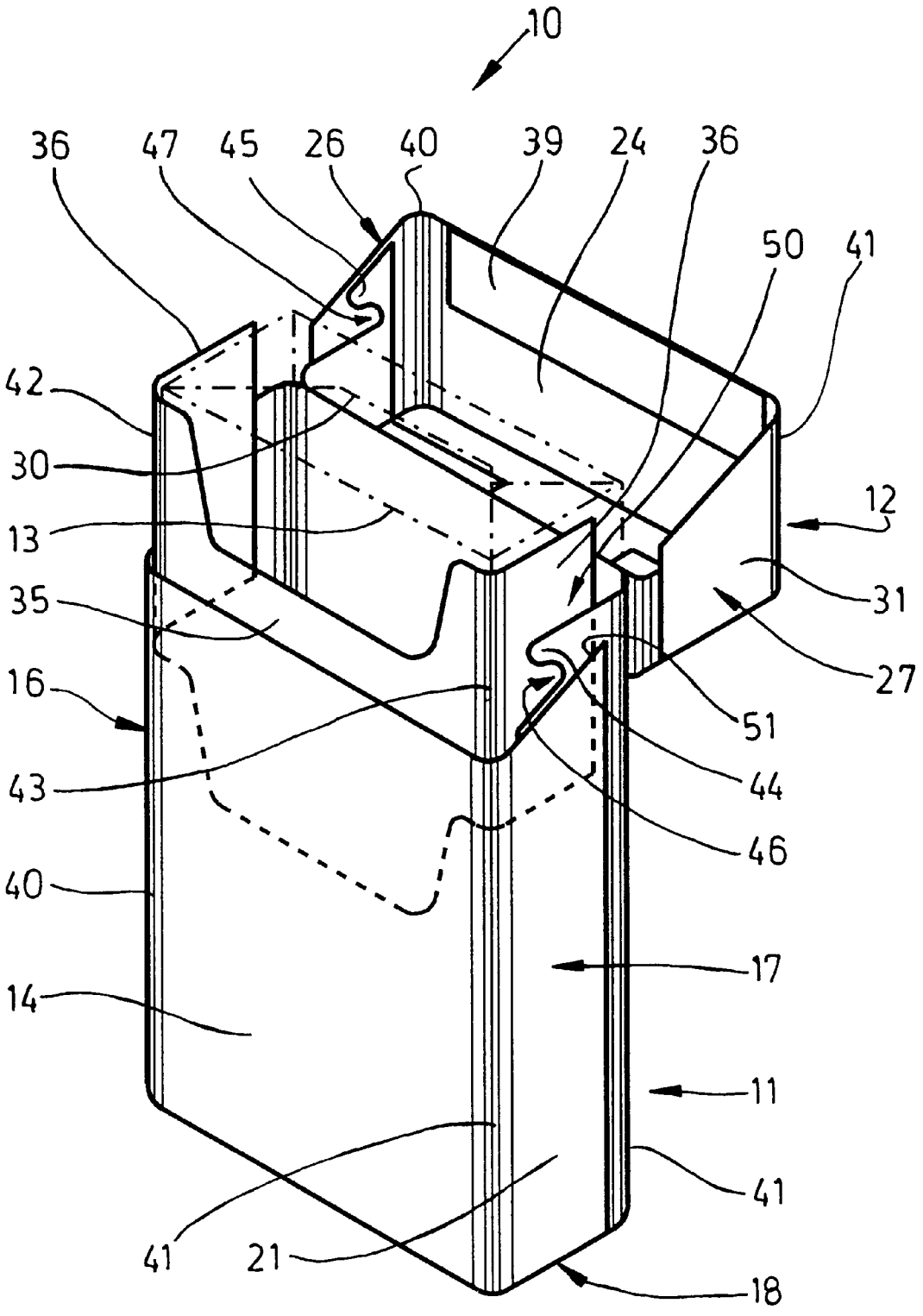

The invention relates to a hinge-lid box for cigarettes, having a box part comprising a front wall, rear wall, base wall and side walls, having a lid comprising a lid front wall, lid top wall, lid side walls and a lid comprising a lid rear wall, which is connected pivotably to the rear wall of the box part, and having a collar which is arranged in the box part and comprises a collar front wall and collar side walls, the collar being partially enclosed by the lid in the closed position. The invention also relates to a blank for producing a hinge-lid box for cigarettes.

Hinge-lid boxes, which are also known as hinge-lid packs, are a widely used type of pack for cigarettes. The cigarettes accommodated in a hinge-lid box are encased by an inner wrapper made of tinfoil or the like and thus forms a cigarette block.

The hinge-lock box comprises a box part and a lid which is arranged pivotably on a rear wall of the box part. A collar is arranged in the box part and, in a top section, projects out of the box part. The free part of the collar is enclosed by the lid in the closed position of the hinge-lid box. The collar may be part of a single-piece blank for producing the hinge-lid box or may be produced from a separate blank.

Upon closure of the cigarette pack, the lid of hinge-lid boxes for cigarettes should be retained in a precise closed position. A closure aid is necessary in particular in the case of hinge-lid boxes with rounded, upright pack edges (round-edges hinge-lid boxes) and in the case of hinge-lid boxes with bevelled, upright pack edges (octagonal hinge-lid boxes, hexagonal hinge-lid boxes). Different solutions are known in practice for this purpose. However, the known solutions for a closure aid either can only be produced with a high degree of production outlay or do not ensure a precise closed position of the lid.

Taking this as a departure point, the problem on which the present invention is based is to propose a hinge-lid box with an easily producible and effective closure aid for the lid of the same.

In order to solve this problem, the hinge-lid box according to the invention is characterized in that formed in the region of the side walls of the box part and in the region of the lid side walls are mutually corresponding protrusions and depressions which, in the closed position of the lid, engage with one another in a frictionally and/or positively locking manner. This ensures a particularly easily producible and effective closure aid for the lid.

Accordingly, in the case of the hinge-lid box according to the invention, the closure aid is formed in the region of narrow side walls of the hinge-lid box, to be precise, between adjacent side walls of the box part, on the one hand, and lid side walls, on the other hand. Accordingly, the closure aid is formed from mutually corresponding elements which are actual constituent parts of the side walls and lid side walls.

In the case of an advantageous development of the invention, adjacent inner side tabs of the side walls and inner lid side tabs of the lid side walls are connected by at least one residual connection, which can be severed when the hinge-lid box is opened for the first time. This achieves the additional effect of the hinge-lid box according to the invention being protected against undesired opening before it is used.

The protrusions and depressions are preferably arranged on the inner side tabs of the side walls and inner lid side tabs of the lid side walls and separated from one another by an undulating punched line. This permits particularly easy production of the hinge-lid box according to the invention.

Figure 4:
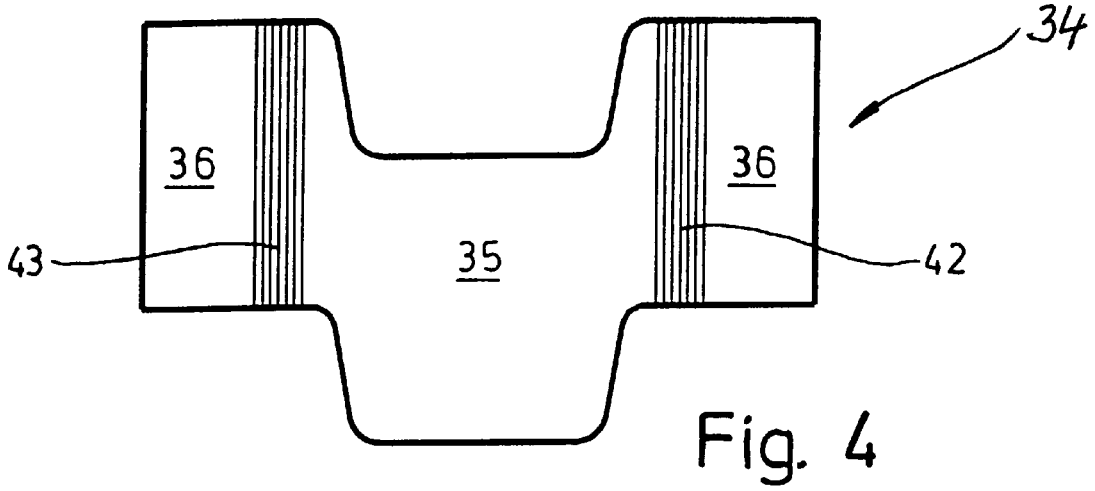
Figure 2:
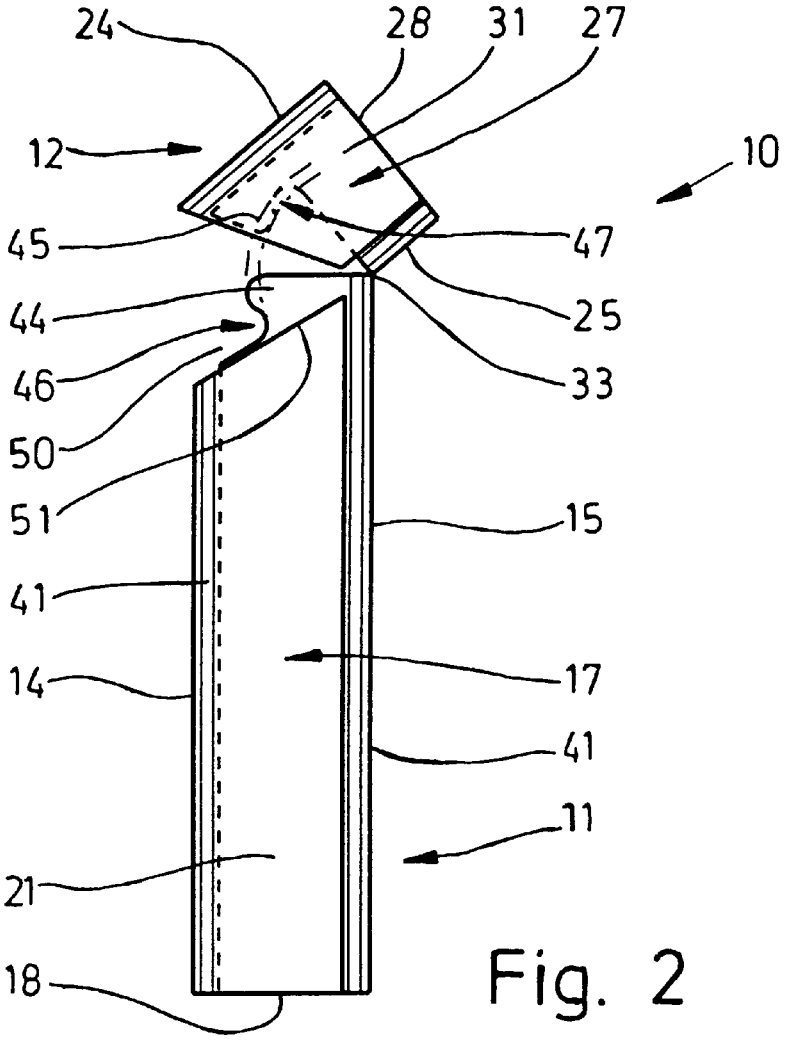
Figure 3:
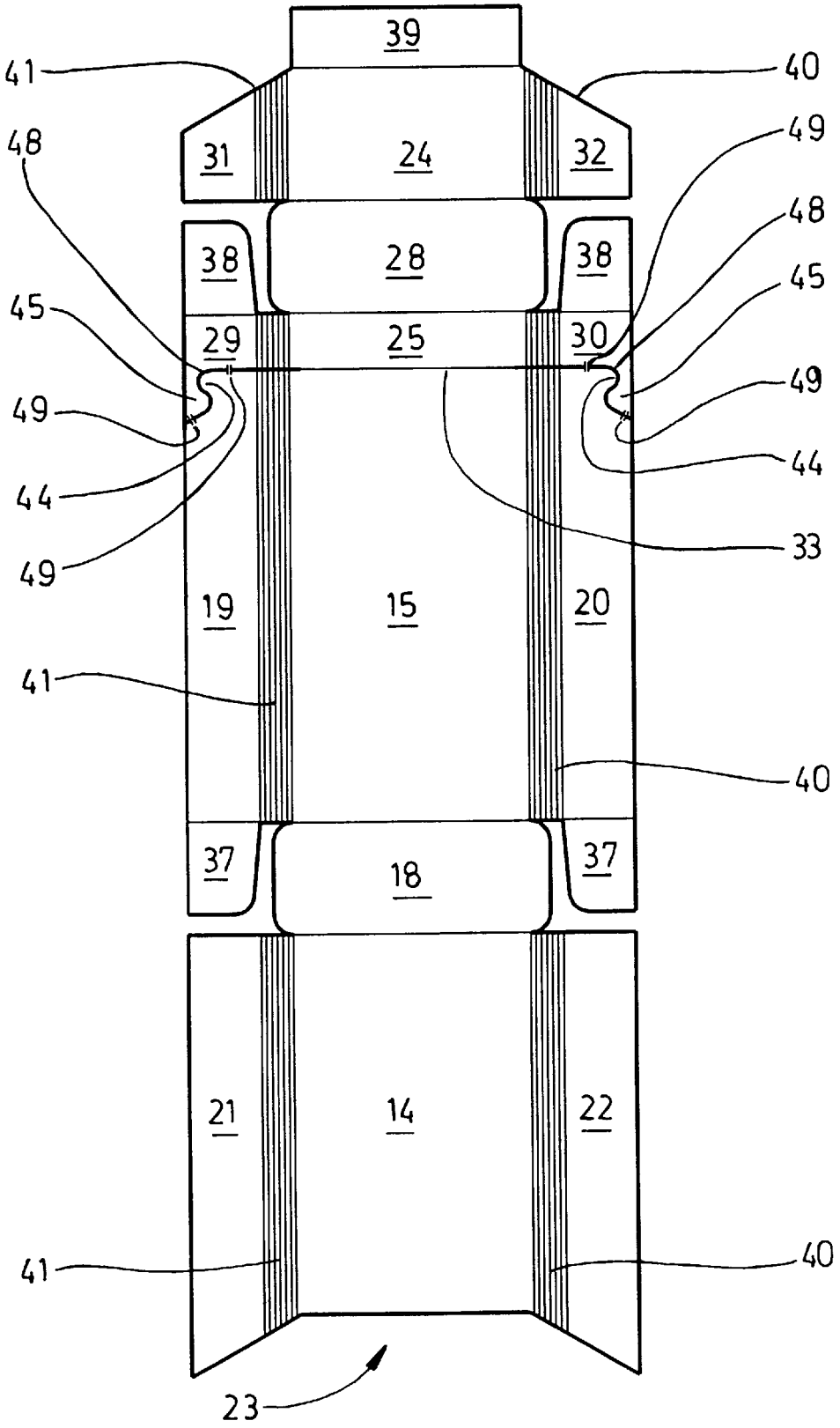

Preferred developments of the hinge-lid box and details of the blank for producing the same can be gathered from the subclaims and the description. An exemplary embodiment of the invention will be explained in more detail with reference to the drawing, in which:

FIG. 1 shows a perspective front view of a hinge-lid box according to the invention in the open position, FIG. 2 shows a side view of the hinge-lid box according to FIG. 1 likewise in the open position, but, for the sake of clarity, without a collar, FIG. 3 shows a plan view of an opened-out blank for the hinge-lid box according to FIGS. 1, 2, and FIG. 4 shows a plan view of an opened-out blank for a collar for the hinge-lid boxes according to FIGS. 1 and 2.

The exemplary embodiment illustrated shows a hinge-lid box for cigarettes—a so-called hinge-lid pack. To be specific, it is a hinge-lid box with rounded pack edges.

A hinge-lid box 10 comprises a box part 11 and a lid 12 and is used for accommodating cigarettes. A cigarette block 13 formed from the cigarettes is indicated in FIG. 1 by chain-dotted lines.

The box part 11 comprises a front wall 14, rear wall 15, side walls 16 and 17 and a base wall 18. The side walls 16, 17 are each formed from inner side tabs 19, 20 and outer side tabs 21, 22 of a single-piece blank 23 for forming the box part 11 and lid 12 of the hinge-lid box 10.

The lid 12 comprises a lid front wall 24, lid rear wall 25, lid side walls 26, 27 and a lid top wall 28. The lid side walls 26, 27 are formed by overlapping inner lid side tabs 29, 30 and outer lid side tabs 31, 32. In the region of the lid rear wall 25, the lid 12 is connected pivotably to the rear wall 15 of the box part 11 via an articulation line 33.

A collar 44, with a collar front wall 35 and collar side walls 36, is seated in the box part 11 of the hinge-lid boxes 10. The collar front wall 35 is connected to the front wall 14 of the box part 11 by adhesive bonding or the like. The collar side walls 36 rest against the inside of the side walls 16, 17, or against the inner side tabs 19, 20, and are connected thereto, as appropriate, by adhesive bonding.

Corner tabs are also important for the hinge-lid box 10. These are base corner tabs 37, on the one hand, and lid corner tabs 38 on the other. The base corner tabs 37 are connected to the adjacent, inner side tabs 19, 20, and the lid corner tabs 38 are connected to the inner lid side tabs 29, 30. The hinge-lid box 10, or the blank 23, also includes a lid inner tab 39, which adjoins the lid front wall 24. When a hinge-lid box 10 is in the finished state, the lid inner tab 39 has been folded over against the inside of the lid front wall 24.

The hinge-lid box 10 shown in the exemplary embodiment is a round-edged pack. Upright pack edges, or longitudinal edges 40, 41, of the hinge-lid box 10 are of rounded or arcuate design. This produces rounded pack edges, the radius of the rounded sections corresponding approximately to the radius of a cigarette. The rounded longitudinal edges 40, 41 of the hinge-lid box 10 extend both in the region of the box part 11 and in the region of the lid 12. Correspondingly, collar edges 42, 43 are also of arcuate or rounded design.

The hinge-lid box 10 according to the invention is provided with a closure aid which, when the hinge-lid box has been closed, retains the lid 12 in a precise closed position, but does not obstruct the opening and closing operation of the hinge-lid box 10. The closure aid of the hinge-lid box 10 according to the invention is explained in more detail hereinbelow:

The closure aid of the hinge-lid box 10 is formed by interacting elements which are arranged in the region of the side walls 16, 17 and lid side walls 26, 27, namely by mutually corresponding protrusions 44, 45 and depressions 46, 47. In the closed position of the hinge-lid box 10, or of the lid 12, the mutually corresponding protrusions 44, 45 and depressions 46, 47 engage with one another in a frictionally and/or positively locking member and thus ensure a precise closed position of the lid 12.

The mutually corresponding protrusions 44, 45 and depressions 46, 47 are assigned to the inner side tabs 19, 20 of the side walls 16, 17 and to the inner lid side tabs 29, 30 of the lid side walls 26, 27, or are arranged thereon. To be specific, each inner side tab 19, 20 is assigned in each case one protrusion 44 and in each case one depression 46. Correspondingly, each inner lid side tab 29, 30 is assigned in each case one protrusion 45 and one depression 47. The protrusions 44 of the inner side tabs 19, 20 correspond to the depressions 47 on the inner lid side tabs 29, 30.

Furthermore, the protrusions 45 of the inner lid side tabs 29, 30 correspond with the depressions 46 of the inner side tabs 19, 20. For the sake of clarity, FIGS. 1, 2 and 3 show the protrusions 44, 45 and depressions 46, 47 in an exaggerated manner.

Accordingly, the closure aid of the hinge-lid box 10 according to the invention is based on the principle that, upon closure of the lid 12, on the one hand the protrusions 44 of the inner side tabs 19, 20 latch into the corresponding depressions 47 of the inner lid side tabs 29, 30 and, on the other hand, the protrusions 45 of the inner lid side tabs 29, 30 latch into the corresponding depressions 46 of the inner side tabs 19, 20. They thus engage with one another in a frictionally and positively locking manner. Unintentional opening of the lid 12, or of the hinge-lid box 10, is not possible since, in order to open the hinge-lid box 10, it is necessary for the respective protrusions 44, 45 of the inner side tabs 19, 20 and inner lid side tabs 29, 30 to be pushed past one another. This is only possible with specific exertion of force on the lid 12.

According to FIG. 3, the adjacent inner side tabs 19, 20 and inner lid side tabs 29, 30 are separated from one another by in each case one undulating punched line 48, the punched line 48 delimiting the contours of the mutually corresponding protrusions 44, 45 and depressions 46, 47. For this purpose, the undulating punched line 48 is designed in the form of an S. The S-shaped configuration of the punched line 48 ensures the formation of the closure aid with particularly simple means.

According to the invention, the punched line 48 for separating inner side tabs 19, 20 and inner lid side tabs 29, 30 runs in an interrupted manner rather than being continuous. As a result, adjacent inner side tabs 19, 20 and inner lid side tabs 29, 30 are connected to one another by a residual connection 49. When the lid 12 of the hinge-lid box 10 is opened for the first time, the residual connections 49 are severed. Accordingly, the lid 12 is additionally secured against unintentional opening before the hinge-lid box 10 is used.

Accordingly, in order to form the residual connections 49, the undulating or S-shaped punched line 48 is interrupted.

According to FIGS. 1 and 3, the inner side tabs 19, 20 of the side walls 16, 17 are of a greater height than the outer side tabs 21, 22 of the side walls. Accordingly, the inner side tabs 19, 20 project beyond the outer side tabs 21, 22 by way of a region 50. The protrusions 44 and depressions 46 of the inner side tabs 19, 20 are arranged in this region 50. In contrast, the inner lid side tabs 29, 30 are of a correspondingly smaller height than the outer lid side tabs 31, 32, with the result that the protrusions 45 and depressions 47 assigned to the inner lid side tabs 29, 30 are covered over by the outer lid side tabs 31, 32. Accordingly, when the hinge-lid box 10 is closed, the closure aid formed from the interacting protrusions 44, 45 and depressions 46, 47 is arranged above an obliquely running closure edge 51 between the box part 11 and lid 12 in the region of the side walls 16, 17 and lid side walls 26, 27.

According to FIG. 3, the blank 23 according to the invention for producing the hinge-lid box 10 has an overall elongate configuration. As in the case of a blank for a conventional hinge-lid box, the walls of the box part 11 and of the lid 12 are arranged so as to follow one after the other. Accordingly, the front wall 14, base wall 18, rear wall 19, lid rear wall 25, lid top wall 28, lid front wall 24 and lid inner tab 39 are arranged in the longitudinal direction of the blank 23 and defined by folding lines. Arranged on both sides of the front wall 14 and rear wall 15 as well as lid front wall 24 and lid rear wall 25 are the side tabs 19 . . . 22 and lid side tabs 29 . . . 32 for forming the side walls 16, 17 and lid side walls 26, 27. The base corner tabs 37 and lid corner tabs 38 respectively join the inner side tabs 19, 20 and inner lid side tabs 29, 30.

The inner side tabs 19, 20 and inner lid side tabs 29, 30 are separated from one another by the undulating punched lines 48, which are interrupted in the region of the residual connections 49. The mutually corresponding protrusions 44, 45 and depressions 46, 47 are formed as a result.

The special features of the hinge-lid box 10 have been explained with reference to the example of the so-called round-edged pack. Of course, the basic idea of the invention can also be used for hinge-lid boxes with bevelled longitudinal edges. Furthermore, the basic idea of the invention can also be used for conventionally configured hinge-lid boxes with a normal rectangular outline.

According to the exemplary embodiment shown, the collar 34 is produced from a separate blank. However, as a departure from the exemplary embodiment shown, it is possible for the hinge-lid box to be formed from a single-piece blank for the box part 11, lid 12 and collar 34.

We claim:

1. A hinge-lid box for cigarettes, having a box part (11) comprising a front wall (14), a rear wall (15), base wall (18) and side walls (16, 17), having a lid (12) comprising a lid front wall (24), lid top wall (28), lid side walls (26, 27) and a lid rear wall (25), which is connected pivotally to the rear wall (15) of the box part (11), and having a collar (34) which is arranged in the box part (11) and comprises a collar front wall (35) and collar side walls (36), the collar (34) being partially enclosed by the lid (12) in the closed position, which comprises the following features:

a) the side walls (16, 17) and the lid side walls (26, 27) are designed with two layers, with inner side tabs (19, 20) and outer side tabs (21, 22), and inner lid side tabs (29, 30) and outer lid side tabs (31, 32), b) formed in the region of the side walls (16, 17) of the box part (11), and in the region of the lid side walls (26, 27), are mutually corresponding protrusions (44, 45) and depressions (46, 47), which, in the closed position, engage with one another in a positively locking manner, c) the protrusions (44, 45) and depressions (46, 47) are formed exclusively in a region (50) of the inner side tabs (19, 20), and of the inner lid side tabs (29, 30), d) the protrusions (44) and depressions (46) of the inner side tabs (19, 20) of the box part (11) are formed at the region (50) that projects over a closure edge (51) of the outer side tabs (21, 22), e) the region (50) with the protrusions (44) and depressions (46) lies on the exterior of the collar side wall and, f) the protrusions (45) and depressions (47) of the inner lid side tab (29, 30) are placed back into the inner part of the lid (12) and lie upon the inner sides of the outer lid side tabs (31, 32).

2. The hinge-lid box as claimed in claim 1, wherein adjacent inner side tabs (19, 20) and inner lid side tabs (29, 30) are connected by at least one residual connection (49) to be severed when the lid (12) is opened for the first time.

3. The hinge-lid box as claimed in claim 2, wherein the inner lid side tabs (29, 30) and the inner side tabs (19, 20) are separated from one another by undulating punched lines (48), the punched lines (48) delimiting the contours of the mutually corresponding protrusions (44, 45) and depressions (46, 47) and each punched line being interrupted by a said residual connection (49).

* * * * *